United States Patent [19]

Flaba

[11] 4,245,439

[45] Jan. 20, 1981

[54] ELEMENT FOR PREFABRICATED BUILDING AND BUILDING OBTAINED WITH SUCH AN ELEMENT

[75] Inventor: Maurice Flaba, Hannut, Belgium

[73] Assignee: Foldaway Research International Anstalt, Vaduz, Liechtenstein

[21] Appl. No.: 951,252

[22] Filed: Oct. 13, 1978

[30] Foreign Application Priority Data

Oct. 13, 1977 [BE] Belgium ..... 181691

[51] Int. Cl.[3] ..... E04B 7/16

[52] U.S. Cl. ..... 52/71; 52/641; 52/645

[58] Field of Search ..... 52/64, 66, 71, 640, 52/641, 645, 79.5, 79.1

[56] References Cited

U.S. PATENT DOCUMENTS

| | | | |
|---|---|---|---|
| 2,499,790 | 3/1950 | Smith | 52/781 |
| 3,485,346 | 12/1969 | Ballard | 52/641 |

FOREIGN PATENT DOCUMENTS

| | | | |
|---|---|---|---|
| 802594 | 2/1951 | Fed. Rep. of Germany | 52/741 |
| 1385350 | 11/1964 | France | 52/641 |
| 142128 | 5/1921 | United Kingdom | 52/641 |

*Primary Examiner*—James L. Ridgill, Jr.

*Attorney, Agent, or Firm*—Cushman, Darby & Cushman

[57] ABSTRACT

There is described a prefabricated building element which comprises at least one frame and at least one closing panel which extends between the inner edges of said frame, connecting means being provided between the frame and the panel, said means being so arranged as to let the frame and panel move relative to one another, along a direction substantially in parallel relationship with the element thickness, to lie in two end positions, the one position in which the panel is received within the thickness of the frame and the other position in which the panel projects relative so said frame.

20 Claims, 16 Drawing Figures

ELEMENT FOR PREFABRICATED BUILDING AND BUILDING OBTAINED WITH SUCH AN ELEMENT

This invention has for object an element for prefabricated building.

The known prefabricated elements for prefabricated buildings the invention pertains to and which will comprise all or part of the building structure as well as the various building walls have the drawback of being usable only for industrial buildings. Indeed to avoid damages during conveying, the visible walls of the elements are received within the thickness of the structure members bordering the elements to let same be stacked without any contacts between said walls. When the building is erected, the structural members remain visible and should it be desired to conceal same, there should be provided joints which project relative to said walls, which imparts to said building an unattractive appearance.

The invention has for object to obviate this drawback and to provide prefabricated elements which allow to make building parts or buildings the walls of which are comprised of conventional materials, such as tiles, bricks, etc . . . . . and have no gap while allowing to conceal the structural members of the elements, said elements being so designed as to be completely manufactured and assembled in the works and to protect the wall associated therewith during the handling and conveying. Moreover said elements can comprise according to the invention, a complete from a building structure or from a building, said section being completely made and assembled in the works while having for the conveying a substantially parallelepiped shape of small size which is easy to handle and store and which can also be erected on the site with simple tooling and without trained workers.

For this purpose according to the invention, the element comprises at least one frame and at least one closing panel which extends between the inner edges of said frame, connecting means being provided betweeen the frame and the panel, said means being so arranged as to let the frame and panel move relative to one another, along a direction substantially in parallel relationship with the element thickness, to lie in two end positions, the one position in which the panel is received within the thickness of the frame and the other position in which the panel projects relative to said frame.

In another embodiment of the invention, said connecting means are so arranged as to fix in position the frame and the panel relative to one another, at least when same lie in both end positions thereof.

In an advantageous embodiment of the invention, the element is comprised of sections, each section comprising a frame and at least one closing panel, said sections being joined and hinged to one another to let same swing relative to one another about an axis in parallel relationship with one element edge, to fold the sections concertina-like on one another.

The invention has also for object a building made by means of said elements.

According to the invention, the building the size and shape of which may be selected by varying the number of elements which comprise same, comprises joints to connect the closing panels, said joints being of the same kind as the panels to be connected, means being provided to fix in position said joints relative to the corresponding closing panels.

Other details and features of the invention will stand out from the following description given by way of non limitative example and with reference to the accompanying drawings, in which.

Figure 1:
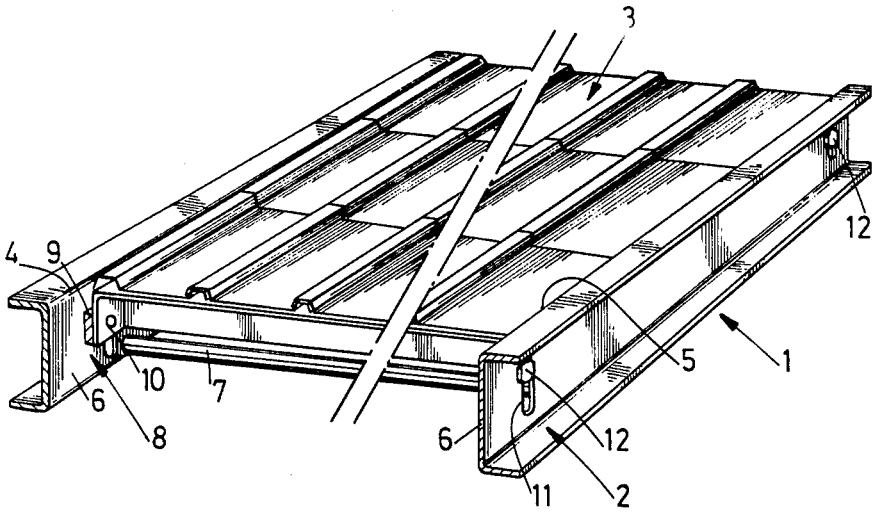
FIG. 1 is a perspective view with parts broken away, of a prefabricated element according to the invention, the closing panel of which is shown in the position it lies in when conveying the element.
Figure 2:
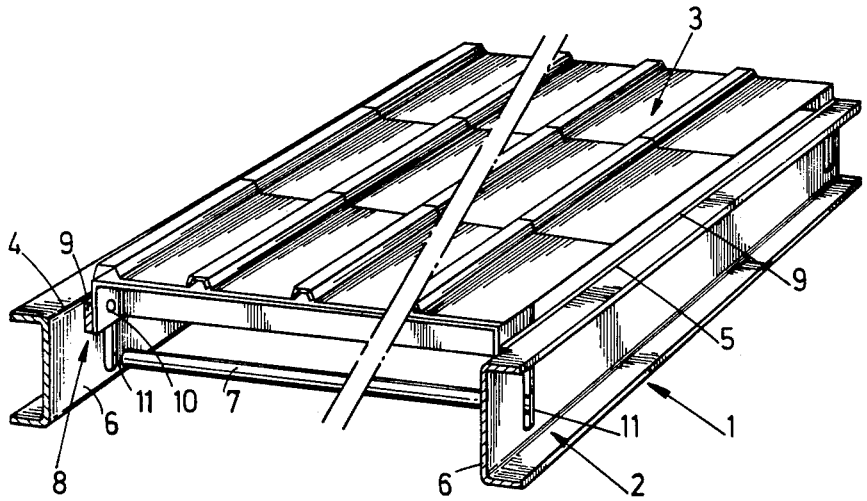
FIG. 2 is a view similar to FIG. 1, the element closing panel being shown in that position it lies in when the element is set.
Figure 3:
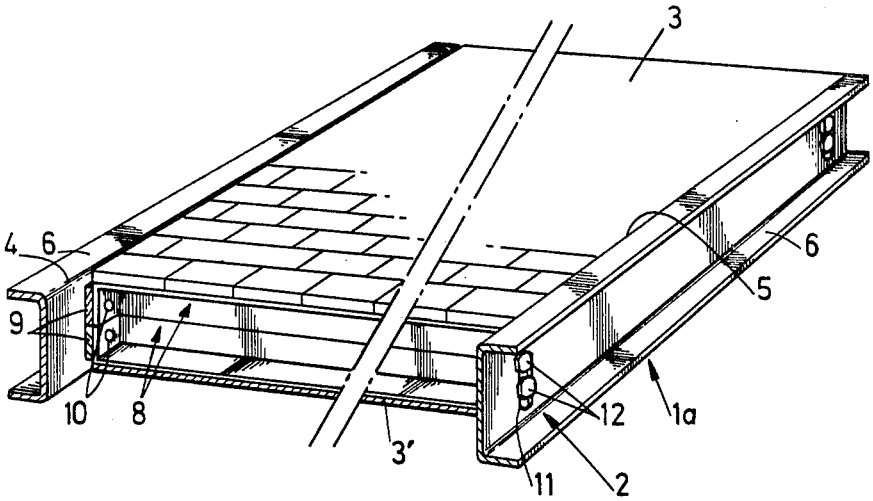
Figure 4:
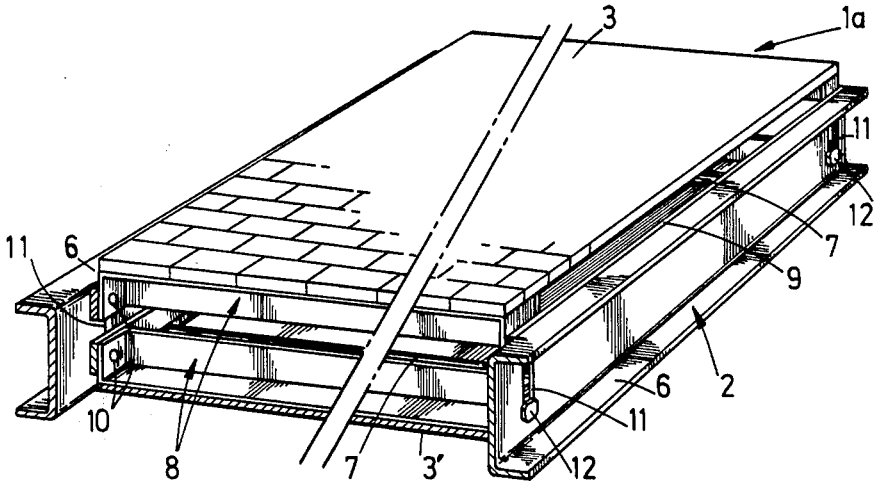

FIGS. 3 and 4 are views similar to FIGS. 1 and 2, showing a variation in the element as shown in FIGS. 1 and 2.

Figure 5:
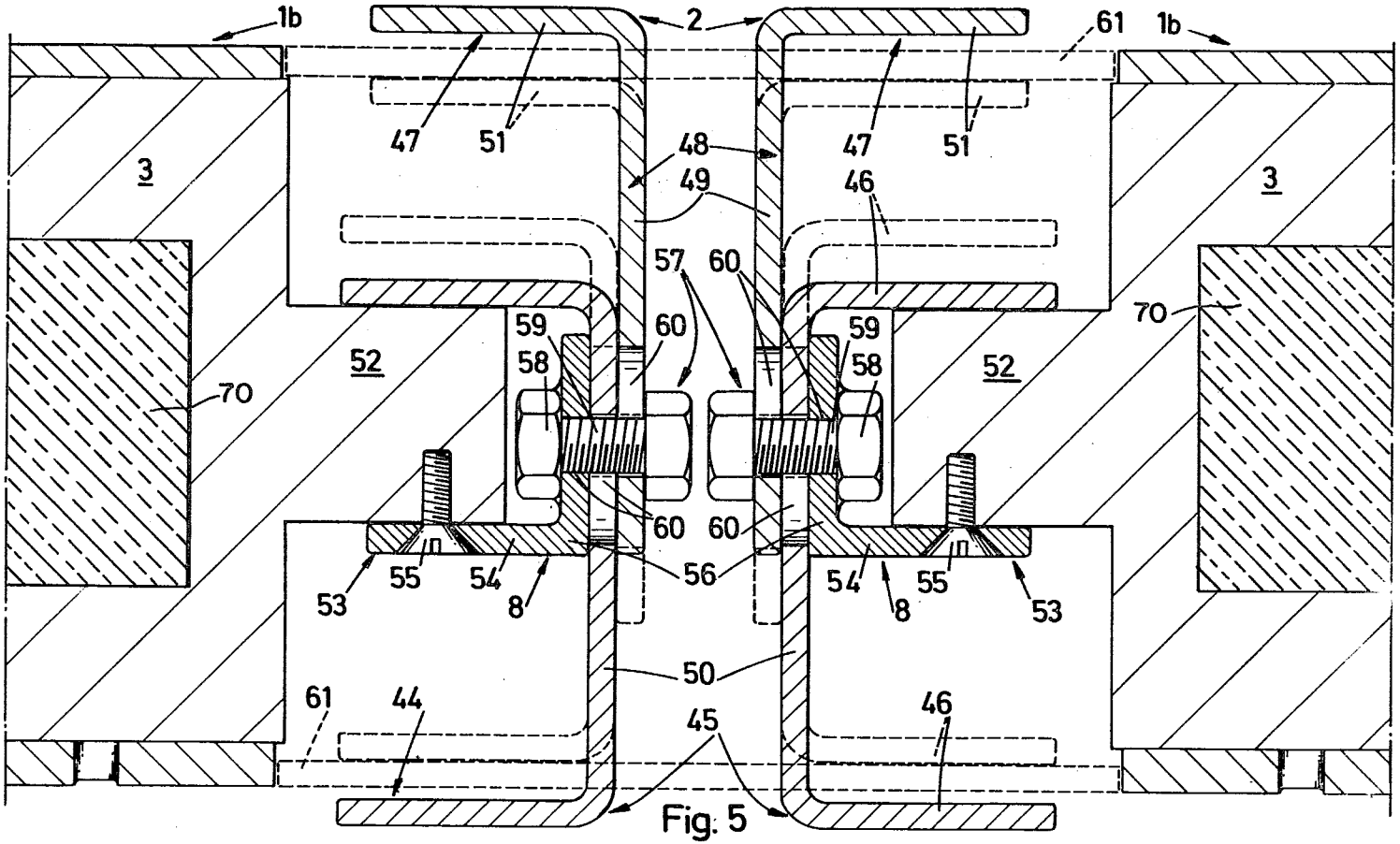

FIG. 5 is a cross-section view with parts broken away showing two elements according to the invention arranged side-by-side, said elements comprising a variation of the elements as shown in FIGS. 1 to 4, the frames of said elements being shown in solid lines in that position they lie in when conveying the elements, and in broken lines in that position they lie in when the elements are set in position.

Figure 6:
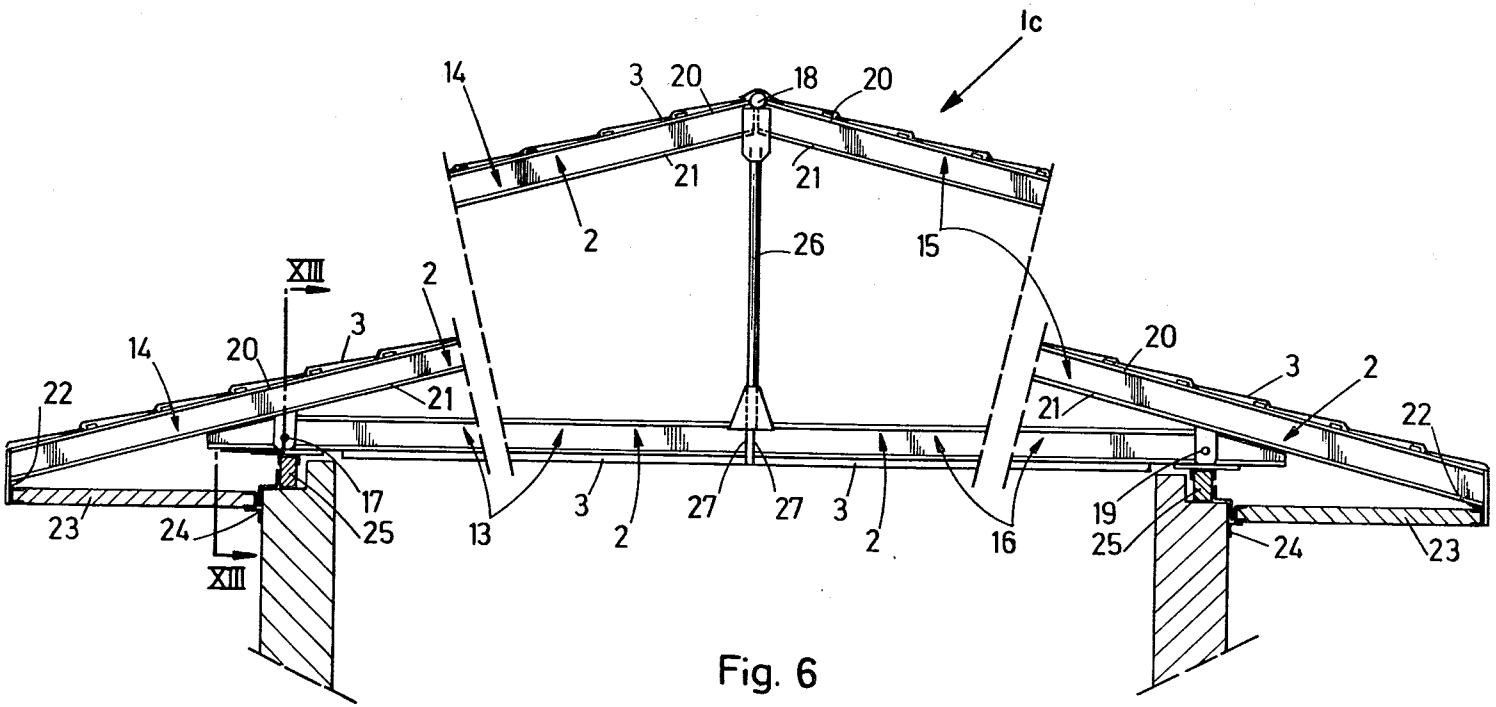
Figure 7A:
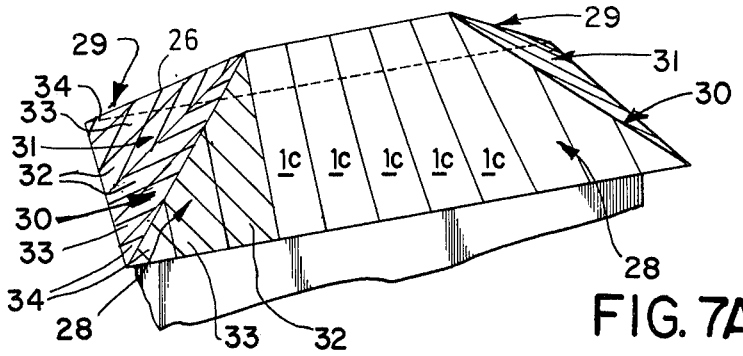
Figure 7B:
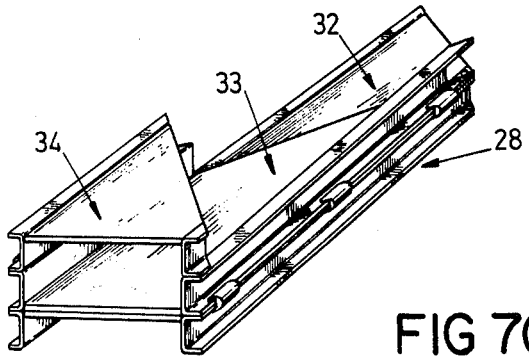
Figure 7C:
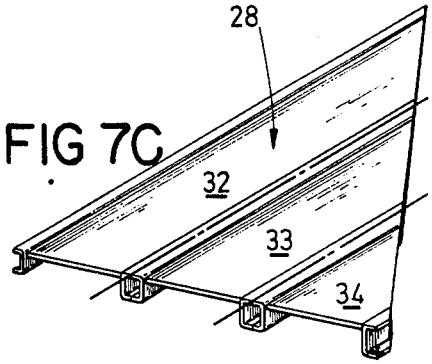
Figure 7D:
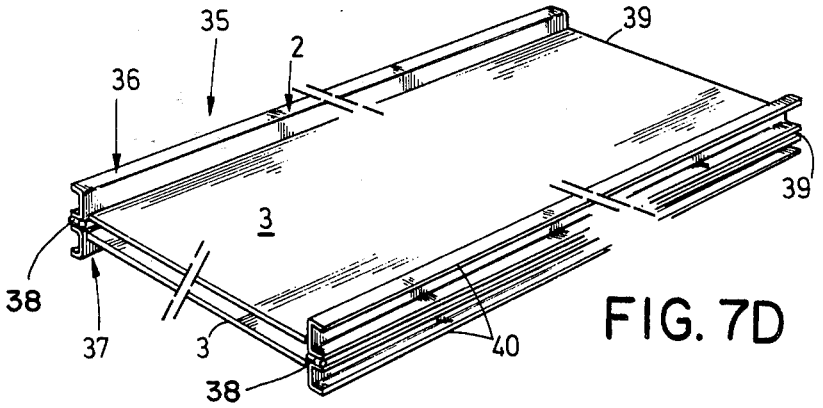

FIG. 6 is an elevation view with parts broken away, of an assembly of elements according to the invention which will comprise a building structure section, with a tile covering and a double-ceiling.

FIG. 7 is a diagrammatic view in perspective showing the arrangement of four elements according to the invention which will comprise one end part of a four-sided building structure, said figure showing one element separately with the axes of those hinges allowing to fold back same for conveying, said element being shown in folded position, as well as one of the elements that form the double-ceiling and which are to be associated to said structure elements when erecting the building roof.

Figure 8:
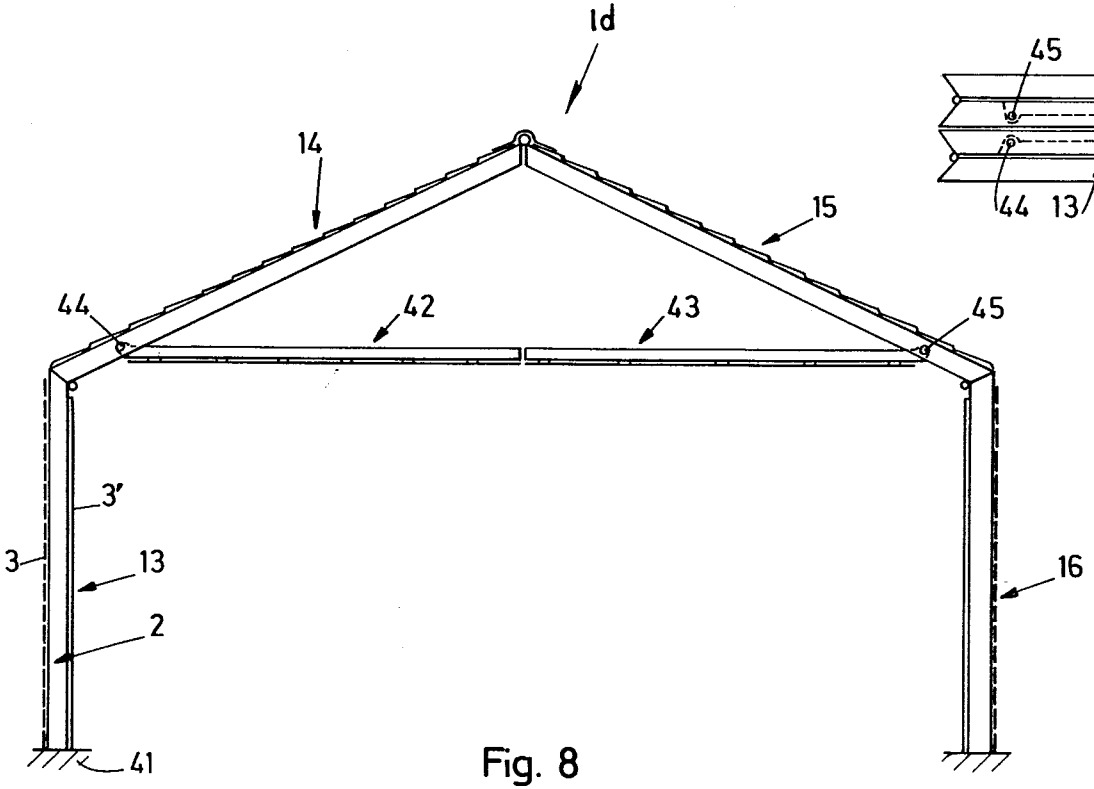

FIG. 8 is a diagrammatic elevation view of a building made by means of element assemblies according to the invention, each assembly being so designated as to comprise a complete building section, namely walls, roof, ceiling or double-ceiling, the element being shown in erected position.

Figure 9:
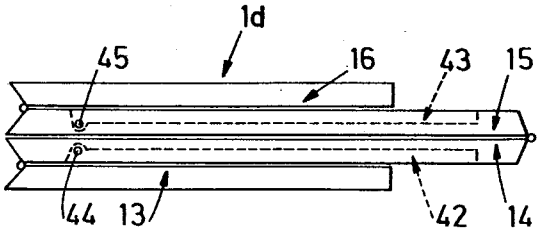

FIG. 9 is a view similar to FIG. 8 with the assembly in the folded position.

Figure 11:
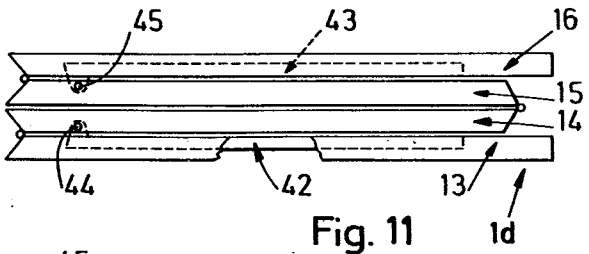
Figure 12:
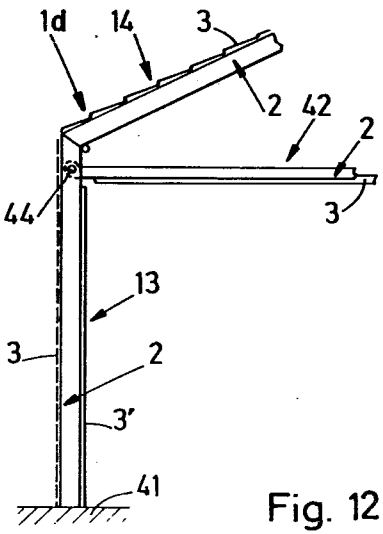
Figure 10:
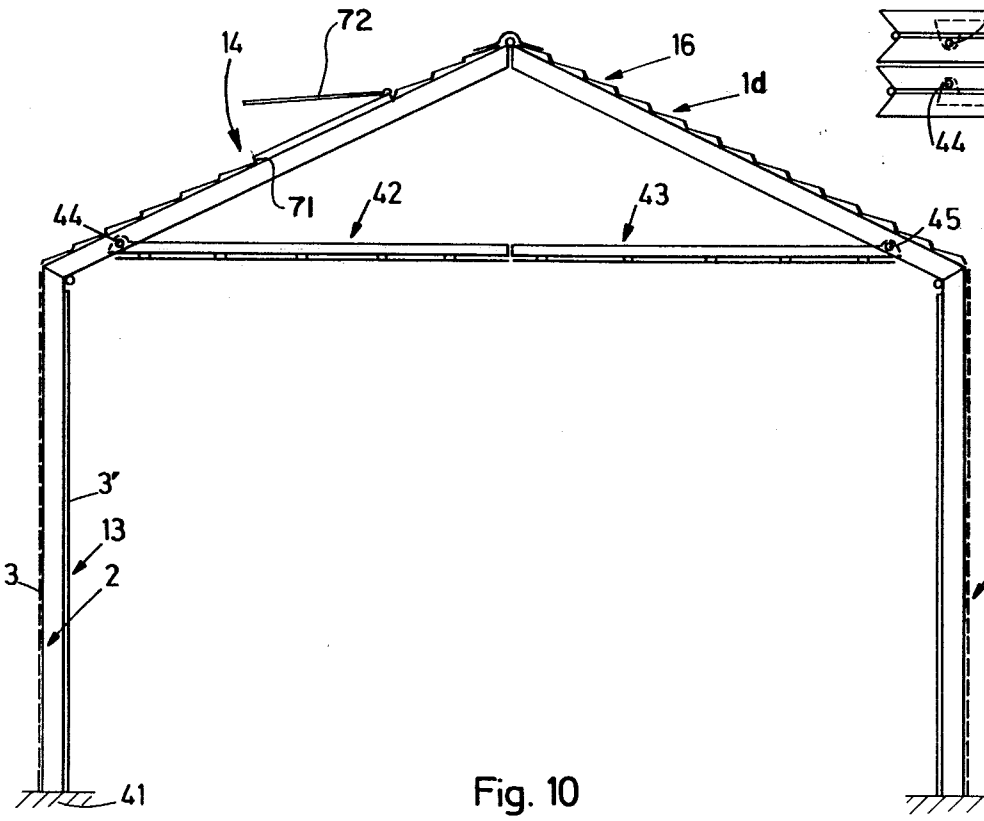

FIGS. 10 to 12 are views with parts broken away similar to FIGS. 8 and 9, showing variations of the assembly shown in FIGS. 8 and 9.

Figure 13:
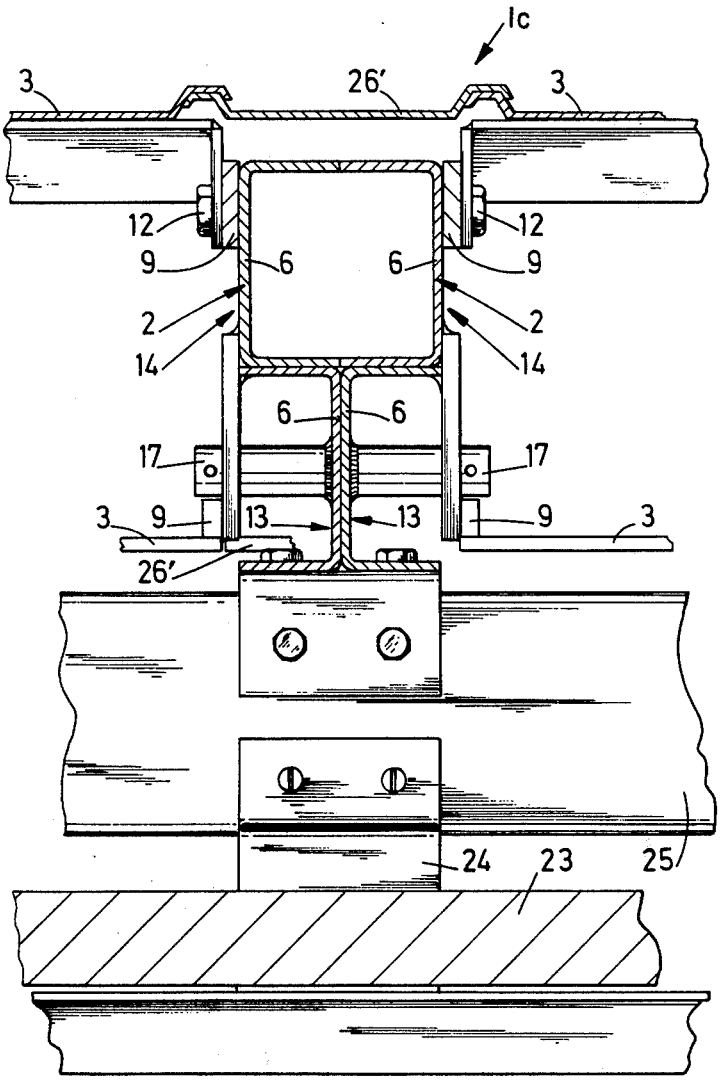

FIG. 13 is a detailed cross-section view along line XIII—XIII in FIG. 6 showing the assembly of two elements shown in FIG. 6 as well as the joint connecting the closing panels of those elements which are to form the building roofing.

In the various figures, the same reference numerals pertain to similar elements.

Element 1 according to the invention and shown in FIGS. 1 and 2 comprises an undistortable frame 2 and a closing panel 3 which extends between edges 4 and 5 of the frame comprised of two U-shaped sections 6 which are assembled by means of braces 7. The closing panel 3 is associated with the frame 2 by connecting means 8 which are so arranged as to let the panel move substantially in parallel relationship with itself and said frame, to lie in two end positions, the one position (FIG. 1) in which the panel is received within the thickness of the frame for the handling, the storage and the conveying of element 1, and another position (FIG. 2) in which the panel projects relative to frame 2, that is the position it lies in when element 1 is associated with other elements for erecting a building.

The element 1*a* as shown in FIGS. 3 and 4 comprises an undistortable frame 2 similar to the above-described frame but comprising two closing panels 3 and 3' arranged in parallel relationship within the frame, the connecting means 8 being so arranged as to let the panels 3 and 3' move relative to the frame 2 and in parallel relationship with one another along opposite directions. The panels as shown in FIG. 3, are received within the thickness of the frame for storing and conveying the element while as shown in FIG. 4, the panels each lie in a projecting position relative to the frame and thus comprise part of the inner and outer coverings of the building comprised of such elements. The connecting means 8 are for example comprised of two parallel stringers 9 made fast to the panels, said stringers in parallel relationship with the frame sections 6, being provided with tapped holes 10 with an axis at right angle to the panel movement direction, said holes being spaced regularly and located level with stud-holes 11 provided in the webs of sections 6 along a direction at right angle to the lengthwise direction of the stringers, screw-bolts 12 cooperating with holes 10 and stud-holes 11 in such a way that when said screw-bolts 12 are loosened, they let the panels move in parallel relationship with themselves and when said screw-bolts are tightened, they enable to fix the panels relative to the frame, in one or the other of said end positions. In said elements may be provided an insulating element 70, not shown, which is fastened inside the frame in such a way as not to hamper the movements of the closing panel or panels, said panels may of course be provided with openings 19 and 20 and possibly with means 72 for closing same, associated with said closing panels.

The elements 1*b* shown in FIG. 5 each comprise a frame 2 and a closing panel 3. The frame 2 is comprised of a first framework 44 formed by a U-shaped section 45 the flanges 46 of which face panel 3 and extend at right angle to the thickness thereof and a second framework 47 formed by an angle part 48 a flange 49 of which bears on web 50 of section 45, while the other flange 51 extends at right angle to the thickness of panel 3 and faces same. Panel 3 is provided along the edges thereof and opposite frame 2, with a projection 52 to which are made fast means 8 connecting panel 3 to frame 2, said connecting means 8 being comprised on the one hand, of an angle part 53 the flange 54 of which is fastened by screws 55, to projection 52 while the other flanges 56 bears on web 50 of section 45 opposite flange 49 of an angle part 48 and on the other hand by screw-bolts 57 the nut 58 of which is made fast by welding, to flange 56 of angle part 53 and the shaft 59 of which passes through openings 60 provided in flanges 49 and 56 of angle parts 48 and 53 as well as in web 50 of section 45. The projection 52 as well as the means 8 and said openings 60 are so arranged as to let flanges 46 and 51 of section 45 and angle part 48 be received on either side of projection 52, within the thickness of panel 3, when the elements are mounted and project on either side of panel 3 for the conveying of said elements. When the elements 1 are assembled, the frames 2 are covered by joints 61.

The element assembly 1*c* as shown in FIG. 6 is comprised of four elements or parts or sections 13, 14, 15 and 16 in the shape of a quadrilateral with four right angles. Each part comprises a frame 2 and a closing panel 3, the end parts 13 and 16 being so designed as to form the structure and the double-ceiling of a building, while parts 14 and 15 comprise the roof structure and the roofing thereof. The part frames 2 are joined and hinged in 17, 18 and 19 to one another, in such a way that the parts may swing to be folded back on one another, concertina-like, for storing or conveying same, that is said parts are so hinged that in folded position, the outer surfaces 20 of the frames in parts 14 and 15 engage one another while the outer surfaces 21 of said frames in parts 14 and 15 engage the frames of parts 13 and 16, the size of the frames in the various parts, as considered in parallel relationship with the hinge axes, being the same while the size of the part frames as considered at right angle to the hinge axis, is the same by pair. The hinges 17 and 19 in FIG. 6, are staggered relative to the edges 22 of parts 14 and 15. According to the invention there is provided a filling element 23 made fast to said edge 22 and supported by lugs 24 fastened to the beams bearing the element assembly 1*c*. FIGS. 6 and 13 show the assembly of parts together. To increase the stiffness of the erected element, it is possible to provide as shown in FIG. 6, a crown-post 26 joining hinge 18 to the ends 27 of parts 13 and 16. When the elements 1 are assembled, a joint 26' is arranged as shown in FIG. 12, between the element closing panels, said joint 26' due to the position of said panels relative to the frame, lying in the extension of said panels and concealing completely said frame. It must be understood that the hinges 17 and 19 could be located along the edges 22 of parts 14 and 15, the parts then being assembled endwise. In that case where the building roof is four-sided, it is possible to use elements 1 as shown in FIG. 6, in association with end elements 28, 29, 30 and 31 as shown in FIG. 7 or else when the building is of square shape, to use only elements as shown in said FIG. 7. Said latter elements are comprised of three parts hinged together to be foldable concertina-like for the conveying thereof, and which are each comprised of a frame with closing panel as described above. During the mounting, said end elements are supported by separate structure components which are arranged during the mounting and associated with prefabricated elements 35 which comprise the structure and the double-ceiling of the building, said elements 35 being comprised of two sections 36 and 37 hinged together in 38, the edges 39 of which are joined to the elements 28 and 29 while the edges 40 are joined to the elements 30 and 31.

The element assembly 1*d* according to the invention and as shown in FIG. 8 to 11, comprises a complete section in a building. Said element thus comprises the walls, the roof as well as a floor or a double-ceiling. To make a building the outer walls of which are completely manufactured and assembled in the works, with the final covering thereof, it would thus be enough to set side-by-side such assemblies 1*d* erected on foundations 41 and to mount end walls obtained for example by means of elements as shown in FIGS. 3 to 5. Said assemblies 1*d* comprise six parts, parts 13 and 16 which will form the building walls, parts 14 and 15 which will form the building roof and intermediate parts 42 and 43 which will comprise either a floor and the support thereof, or a double-ceiling and the support thereof. Depending on the building size, the intermediate parts 42 and 43 hinged in 44 and 45 on the parts 14 and 15, fit when the element lies in storage or conveying position, either as shown in FIGS. 8 and 9, within the parts 14 and 15 in such a way that the frames of parts 13 and 16 might bear on the frames of parts 14 and 15, or as shown in FIGS. 10 and 11, within parts 13 and 16, still in such a way that the frames thereof might bear on the frames of parts 14 and 15, the movable closing panels of the various parts being of course received in said part position, inside the part frames. It would also be possible for element assembly 1*c* as shown in FIG. 6, to arrange the hinges in such a way that parts 13 and 16 fit within parts 14 and 15 when the element lies in the storage or conveying position thereof. The assemblies comprised of a plurality of parts comprise means so arranged as to lock the parts together when the element is erected. Said means may be comprised in the case of that element shown in FIG. 8, of the crown-post 26. Said means are also adjustable to allow from a particular element, varying the angle formed by parts 14 and 15 as well as the angle formed by each one of the parts 13 and 16 with the corresponding part 14 or 15.

It must be understood that the invention is in no way, limited to the above embodiments and that many changes can be brought therein without departing from the scope of the invention as defined in the appended claims.

It would of course be possible to provide according to the stresses the element will have to bear, a frame 2 which would be comprised only of two parallel sections 6 between which are arranged said closing panel or panels with said connecting means 8 as described above, the stiffness of the frame-panel unit being provided when tightening the screw-bolts 12 of means 8 as the panel or panels lie in either end position thereof.

It would further be possible for the elements as shown in FIGS. 8 to 11, to provide as shown in FIG. 12, the arrangement of the hinges of intermediate parts 42 and 43 on parts 13 and 16 instead of on parts 14 and 15.

I claim:

1. Element for prefabricating building, which comprises at least one frame and at least one closing panel which extends between the inner edges of said frame, connecting means being provided between the frame and the panel, said means being so arranged as to let the frame and panel move relative to one another, along a direction substantially in parallel relationship with the element thickness, to lie in two end positions, the one position in which the panel is received within the thickness of the frame and the other position in which the panel projects relative to said frame.

2. Element as defined in claim 1, in which said connecting means are so arranged as to fix in position the frame and the panel relative to one another, at least when same lie in both end positions thereof.

3. Element as defined in claim 1, in which the connecting means provided between the frame and the closing panel are comprised of at least two parallel stringers from the panel, said stringers in parallel relationship with the corresponding frame components, being provided with tapped holes the axis of which is at right angle to the panel movement direction, said holes being regularly spaced and located facing stud-holes provided in the frame along a direction at right angles to the stringer lengthwise axis, screw-bolts cooperating with the tapped holes and the stud-holes in such a way that when said bolts are loosened, they let the panel move in parallel relationship with itself and when they are tightened, they enable fixing the panel relative to the frame in one of said end positions thereof.

4. Element as defined in claim 1, which comprises openings and means for closing same associated with the frame closing panels.

5. A building comprised of a plurality of elements as defined in claim 1, said elements being set side-by-side and fastened to one another.

6. A building as defined in claim 5, which comprises joints for connecting the element closing panels, said joints being of the same kind as the panels to be joined, means being provided to fix said joints relative to the corresponding closing panels.

7. Element as defined in either one of claim 1 or 2, in which the frame is comprised of at least two parts so arranged as to be slidable relative to one another along said direction in substantial parallel relationship with the element thickness, to lie in two end positions, the one position in which the panel is received within the frame thickness and another position in which the panel projects from said frame on either side thereof.

8. Element as defined in claim 7, in which the frame is comprised of a first framework formed by a U-shaped section the flanges of which face the panel and extend at right angle to the panel thickness, and of a second framework formed by an angle part the one flange of which bears on the U-profile web while the other flange extends at right angle to the panel thickness and faces said panel, the panel being provided along the edges thereof and facing the frame with a projection to which are made fast the connecting means, said connecting means being comprised on the one hand of an angle part the one flange of which is fastened to the projection in parallel relationship with the U-profile flanges, while the other flange bears on the U-profile web opposite the flange of said frame angle part, and on the other hand by screw-bolts the nut of which is fastened to the flange of that angle part made fast to the projection and the shaft of which passes through openings provided in said angle part as well as in the web of said U-profile and in the flange of that frame angle part which cooperates with said profile, the projection and the connecting means being moreover so arranged as to let the flanges of the U-profile and the flange of the frame angle part in parallel relationship with the profile flanges fit on either side of the projection within the panel thickness.

9. Element as defined in either one of claim 1 or 2, in which the frame, the panel and the connecting means provided between the frame and the panel are so arranged as to let the panel move substantially in parallel relationship with itself and the frame, to lie in two end positions, the one position in which the panel is received within the frame thickness and another position in which the panel projects relative to said frame.

10. Element as defined in claim 9, which comprises two closing panels arranged in parallel relationship in the frame, said connecting means being so arranged as to let the closing panels move relative to the frame and in parallel relationship with one another along opposite directions, either to be received within the frame thickness, or to project relative to said frame on either side thereof.

11. Element as defined in claim 10, in which an insulating element is provided between both closing panels of said frame.

12. An assembly of elements each of which is as defined in claim 1, said elements being joined and hinged to one another to let same swing relative to one another about an axis in parallel relationship with one element edge, to fold the sections concertina-like on one another.

13. An assembly as defined in claim 12, which comprises a structure comprised of four elements in the shape of a quadrilateral with four right angles, the end elements of the assembly having to form either the double-ceiling of the building or the side walls thereof, while the two other elements comprise the roof sides, the element hinges being so arranged as to let in folded position, the outer surfaces of those elements comprising the roof sides contact one another while the end elements the sizes of which are smaller than the sizes of those elements comprising the roof sides, fit therein.

14. An assembly as defined in claim 12, which comprises assembly means allowing to join the assembly to the building foundation.

15. An assembly as defined in claim 12, which comprises a structure formed by four of said elements in the shape of quadrilateral with four right angles, the end elements of the assembly having to form either the side walls of the building or the double-ceiling thereof, while the two other elements comprise the roof sides, the elements being hinged in such a way that in folded position, the outer surfaces of those elements forming the roof sides contact one another while the inner surfaces of said elements engage the inner surface of those elements comprising the side walls or the double-ceiling of the building, the sizes of the various elements as considered in parallel relationship with the hinge axis being the same, while the sizes of the elements as considered at right angle to the hinge axis are the same by pair

16. An assembly as defined in claim 15, which comprises two intermediate elements, each intermediate element being hinged on one end element.

17. An assembly as defined in claim 15, which comprises two intermediate elements, each intermediate element being hinged on an element comprising one roof side, the hinge axes of said intermediate elements being in parallel relationship and at the same spacing from the hinge axis of those elements forming the roof sides, said intermediate elements having the same size, the dimension thereof as considered in parallel relationship with the hinge axis being shorter than the corresponding dimension of the other elements while the dimension thereof as considered at right angle to the hinge axis is shorter than the spacing between the hinge axis of an intermediate element and the frame edge of the corresponding roof side-forming element nearest the hinge axis of those elements forming said roof sides, each such intermediate element comprising a frame and at least one closing panel as well as connecting means between the frame and the panel, said connecting means being so arranged as to let said panel move between said two end positions, the hinges of the intermediate elements and said end elements being so arranged as to let in the folded assembly position, the intermediate elements fold back on the inner surfaces of those elements comprising the roof sides and fit within said end elements when the inner surfaces thereof engage the inner surfaces of those elements comprising the roof sides.

18. An assembly as defined in claim 15, which comprises two intermediate elements, each intermediate element being hinged on an element comprising one roof side, the hinge axis of said intermediate elements being in parallel relationship and at the same spacing from the hinge axis of those elements forming the roof sides, said intermediate elements having the same size, the dimension thereof as considered in parallel relationship with the hinge axis, being shorter than the corresponding dimension of the other elements, while the dimension thereof as considered at right angle to the hinge axis, is shorter than the spacing between the hinge axis of an intermediate element from the corresponding roof side-forming element frame nearest and in parallel relationship with the hinge axis of those elements forming said roof sides, the hinges of the intermediate sections, each intermediate element comprising a frame and at least one closing panel as well as connecting means between the frame and the panel, so arranged as to let the panel move between said two end positions, being so arranged as to let in folded position, said intermediate elements fit within those elements comprising the roof sides, the hinges of said latter elements and of said end elements being so arranged as to let the inner surfaces of the end elements engage the inner surfaces of the roof side-forming elements.

19. An assembly as defined in any one of claims 12, 13, 15, 16, 17 or 18, in which means are provided to lock the elements relative to one another when the assembly is erected.

20. An assembly as defined in claim 19, in which the means provided for locking the elements are adjustable to allow varying the angle formed by those elements comprising the roof sides as well as the angle formed by each such element and the corresponding end element.

* * * * *